United States Patent [19]

Kittredge et al.

[11] 4,078,789

[45] Mar. 14, 1978

[54] DOCUMENT INVERTER

[76] Inventors: Lloyd G. Kittredge, 53 Flint St., Trumbull, Conn. 06611; Andrew W. Rastorguyeff, 13 Lounsbury Ave., Norwalk, Conn. 06851

[21] Appl. No.: 761,280

[22] Filed: Jan. 21, 1977

[51] Int. Cl.[2] ..... B65H 29/66

[52] U.S. Cl. ..... 271/65; 271/186; 271/DIG. 9

[58] Field of Search ..... 271/65, 186, DIG. 9

[56] References Cited

U.S. PATENT DOCUMENTS

| | | | |
|---|---|---|---|
| 700,722 | 5/1902 | Appel | 271/DIG. 9 |
| 3,416,791 | 12/1968 | Beckman | 271/65 |
| 3,724,657 | 4/1973 | Katagiri | 271/64 X |

*Primary Examiner*—Richard A. Schacher

[57] ABSTRACT

A document inverter is disclosed which may be utilized in conjunction with a belt conveyor wherein the document is conveyed along a continuous path before and after being inverted. Means is provided for selectively determining whether the document should be inverted or allowed to continue along the path uninterrupted.

7 Claims, 5 Drawing Figures

DOCUMENT INVERTER

BACKGROUND OF THE INVENTION

In the paper handling field, it is sometimes desireable to have means for selectively inverting items such as documents, sheets, pages, and the like, either singly or in pluralities, which hereinafter will be collectively referred to as documents. An example of such a need is where a plurality of stacks of documents, each member in the stack being identical, is to be collated and the stacks are not oriented with regard to the face-side of the documents. Although many devices have been provided for inverting or flipping sheets, heretofore, the inventors are not aware of any device which is utilized with an endless conveyor and which allows both the inverted documents and those which are allowed to be conveyed in an uninterrupted fashion to be conveyed along the same path.

BRIEF DESCRIPTION OF THE INVENTION

In a preferred embodiment of the invention, an inverter device is located between a pair of conveyor belts. Rollers are provided to deflect a document or be inverted into a chute and to subsequently retrieve the document in an inverted fashion. The document is then fed to a discharge conveyor belt. Selection means is provided so that the inverter is short-circuited and a document is allowed to be fed from one belt conveyor to the second belt conveyor in an uninterrupted fashion along a continuous path. A second embodiment of the invention uses roller means in conjunction with a single endless conveyor. This second embodiment utilizes a deflector between individual members of the conveyor to deflect the leading edge of a document into the roller means which in turn directs the document into a chute. The trailing edge of the document when inserted into the chute then becomes the leading edge and the roller means direct the document back to the conveyor. A third embodiment allows a document to be inverted or to be conveyed in an uninterrupted fashion with all documents substantially following the same path no matter how acted upon.

DETAILED DESCRIPTION OF THE PREFERRED EMBODIMENT

Figure 2:
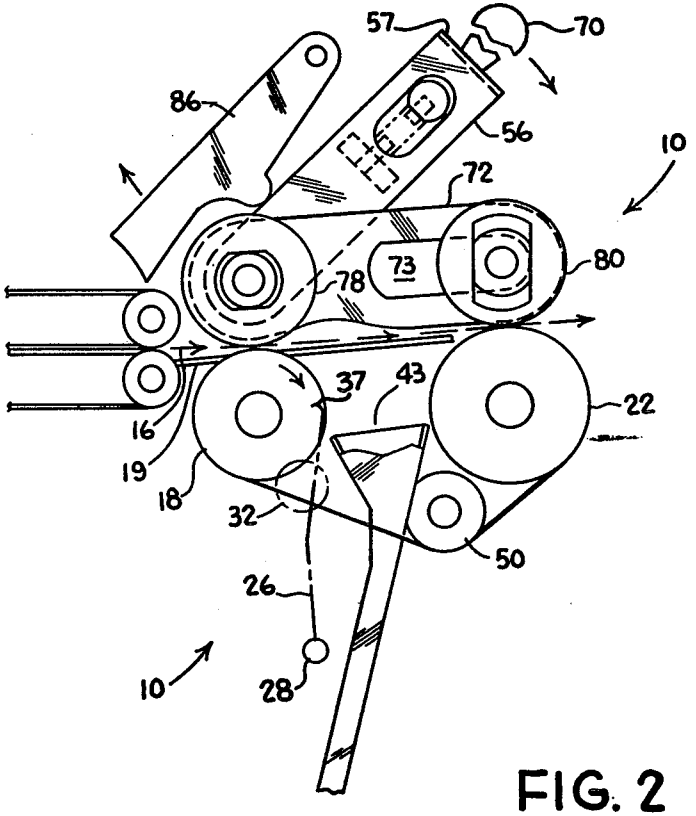
FIG. 2 shows the document inverter of FIG. 1 in a different mode of operation.
Figure 1:
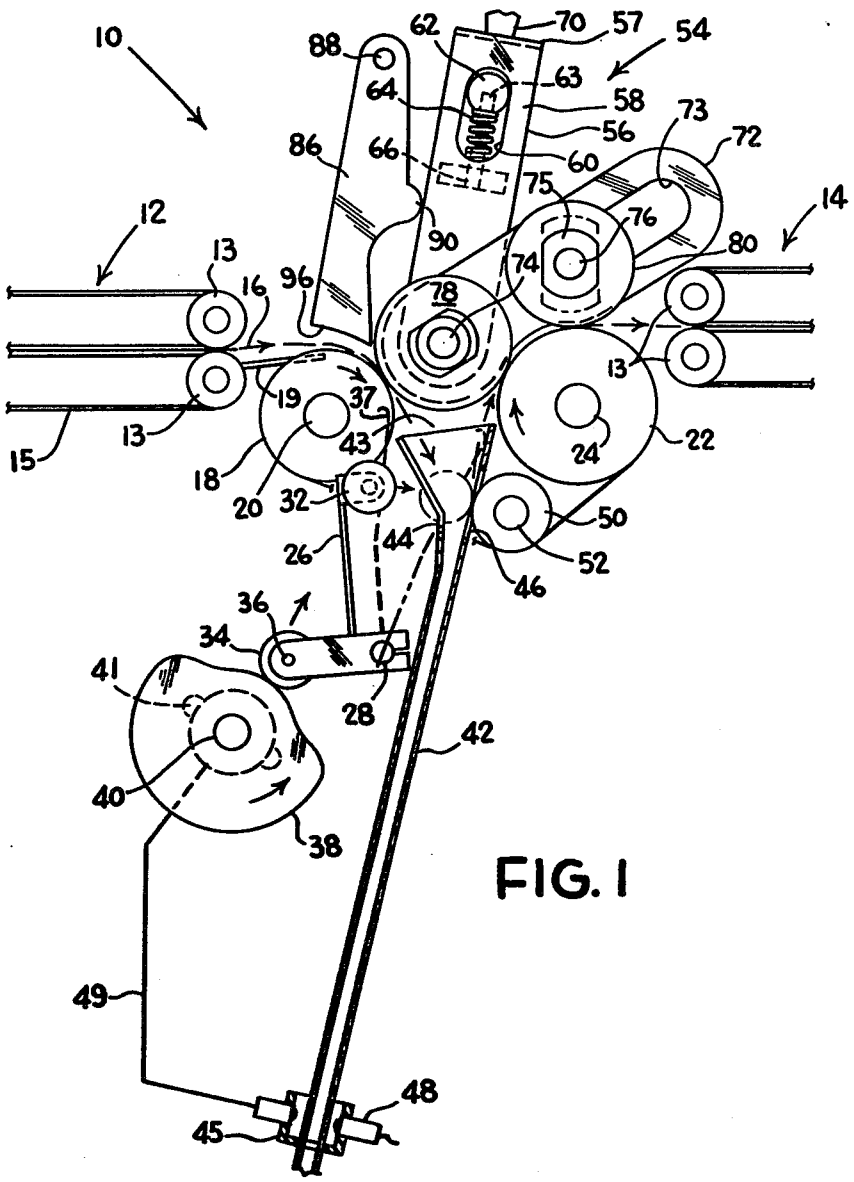
FIG. 1 shows a longitudinal cross-sectional view of a document inverter which incorporates the features of the instant invention.

Referring now to FIGS. 1 and 2, a preferred embodiment is shown of a document inverter, generally shown at 10, which is located between a pair of endless belt conveyors 12 and 14. Preferably the endless conveyors 12, 14 will comprise a plurality of belts 15 spaced laterally relative to one another and trained about a pair of pulleys 13, only one pulley of each pair being shown for each combination of belts. The belt conveyors 12, 14 are operative to convey a document 16 along a continuous path in a direction from left to right, as shown in FIGS. 1 and 2. Immediately downstream from the first belt conveyor 12 is an input roller 18 which is disposed about a drive shaft 20 for rotation therewith. A guide member 19 is located intermediate the belt assembly 12 and the roller 18 to assure deliverance of the document 16 to the roller. The guide member may assume one of two positions as seen in FIGS. 1 and 2 by appropriate mechanical linkage (not shown). Located adjacent the upstream end of the belt conveyor 14 is a second roller 22 which is mounted on a drive shaft 24 for rotation therewith. Located below the roller 18 are a pair of laterally spaced linkage assemblies 26 (only one being seen in FIGS. 1 and 2) which are pivotally supported upon a pivot shaft 28 for pivotable rotation thereabout. Located at the upper portion of each linkage assembly 26 is a rotatable roller 32 and located at the lower portion of each linkage assembly is another roller 34 which is rotatably supported by a pin 36. A leaf spring 37 is secured to the linkage assembly 26 and extends thereabove. Engaging each roller 34 is a cam 38, which cams are disposed upon a drive shaft 40. A one revolution clutch 41 is provided to selectively transmit drive to the drive shaft 40.

Disposed intermediate to and extending below the rollers 18, 22 it is a chute 42 which is operative to receive a document 16 through an opening 43, the length of the chute 42 being adjustable through a bracket 45 to accommodate documents of various sizes. The chute 42 has a pair of openings 44 therein which are aligned with the rollers 32 so that upon rotation of the cam 38 the roller 32 may be received within the chute 42. The chute 42 has a second pair of openings 46 which are in registration with the first openings 44. Located at the bottom of the chute 42 is a sensor 48 which is operative to sense the depositing of a document 16 within the chute. An electrical lead 49 extends from the sensor 48 to the one revolution clutch 41 in order to enable the same. Located below the roller 22 is an urging roller 50 that is mounted on a drive shaft 52 which is driven in unison with the drive shafts 20, 24 by appropriate drive means (not shown).

Located immediately above the rollers 18, 22 is a directing member shown generally at 54 which includes a generally U-shaped member 56 having a laterally extending support member 57 from which depend opposed arm members 58 each of which has an opening 60 therein. Received within each of the openings 60 is a laterally extending rotatable shaft 62. A laterally extending bar 63 extends between the arm members 58. A spring 64 is supported by the bar 63 and extends to the support member 57 where it receives a stud member 68 which supports the spring on the shaft 62. The other end of the spring 64 receives a stud 66 which is secured to the bar 63. A handle 70 is attached to the top of the support member 57. This construction allows the directing member 56 to be lifted to compress the spring 64 and to be rotated through rotation of the shaft 62 into one of two positions shown in FIGS. 1 and 2 respectively.

Secured to the lower portion of each arm member 58 is a guide member 72 having an elongate opening 73. The guide member 72 receives a rod 74 that is supported by the arms 58. Disposed within the opening 73 of the guide member 72 is a slidable bearing 75 supported by a fixed shaft 76. Disposed about the first shaft 74 are a number of idler rollers 78 and disposed about the fixed shaft 76 is another plurality of idler rollers 80, the idler rollers being in engagement with the drive rollers 18 and 22, respectively.

A laterally extending deflection member 86 is pivotally supported by a fixed shaft 88 and has a pair of projections 90 which slidably bear upon the arms 58. The end of the deflection member 86 distal from the shaft 88 has a curvalinear surface 96, the curvature of which is in conformity with the roller 18.

When it is desired to invert documents 16 which are being conveyed along the path defined by conveying means 12 and 14, as indicated by the arrows in FIGS. 1 and 2, the directing member 54 is placed in a position as indicated in FIG. 1. In this position the upstream idler roller 78 is located intermediate the drive rollers 18, 22 and the deflector member 86 is adjacent the path. A document 16 is conveyed by the conveying means 12. It is received between the curvalinear surface 96 and the drive roller 18 to be guided into the nip between drive roller 18 and idler roller 78. The leading edge of the document 16 enters the opening 43 and is received within the chute 42. When the document 16 reaches the bottom of the chute, it is sensed by the sensing member 48. This enables the one revolution clutch 41 causing the drive shaft 40 to rotate the cam 38 one revolution. With the rotation of cam 38, the linkage assembly 26 will pivot about pivot pin 28 as a result of the roller 34 being in contact with the rotating cam 38. Upon rotation of the linkage assembly 26, the leaf spring 37 will engage the document 16 and the pressure roller 32 will be directed toward and into the opening 44 to press the top of the document 16 locates with the chute 42 against the drive roller 50. This will drive the document 16 into the nip between the drive roller 22 and idler roller 78 to consequently be driven through the nip of the drive roller 22 and idler roller 80. As the document 16 exits from the drive roller 22 and idler roller 80, it is received within the conveying belts 14 to be conveyed along its original path but in an inverted orientation. Thus the apparatus is capable of inverting a document without changing the direction of the document 16 were the same not inverted. It will be noted that the center line of the chute 42, that is the bisecting line between the walls of the chute, is generally tangential to both the drive roller 22 and the idler roller 78. This orientation aids in alignment of the document 16 which is to be fed between these two rollers 22, 28.

When there is no requirement to invert documents 16, the directing member 56 is moved out of the way by an operator lifting the same through the handle 70. As the directing member 56 is pulled upwardly, as a result of being lifted by the handle 70, the spring 64 is compressed and the directing member may be pivoted with the pivot shaft 62 to be placed in the position as shown in FIG. 2 after the handle 70 is released and the spring 64 is allowed to expand. In this way, a document 16 may be conveyed from the belt conveyors 12 between the drive roller 18 and idler roller 78, thence between the drive roller 22, idler roller 80 and into the belt conveyors 14 without the same being inverted. It will be observed that the idler roller 80 remains in the same location but the guide plate 72 moves relative thereto upon the bearing 75 to place the idler roller 80 at the extreme end of the guide plate 72 relative to the opposite idler roller 72. Additionally, the deflection member 86 is removed from adjacent the path so as not to interfere with the conveying of document 16 and the guide 19 is extended when the directing member is rotated counter-clockwise as shown in FIG. 2.

Figure 3A:
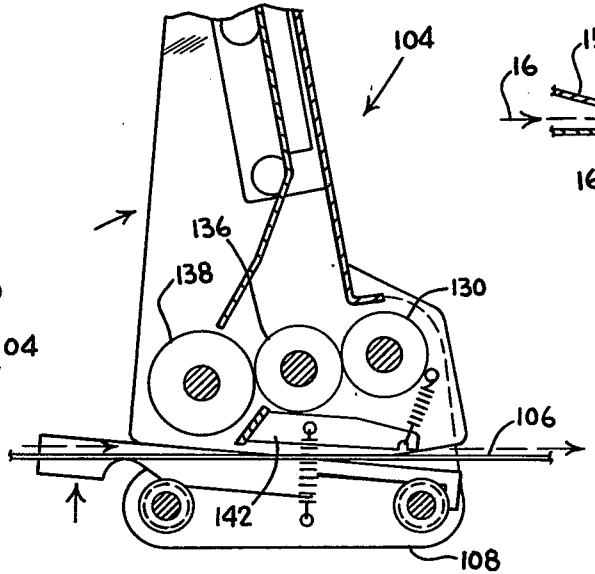
FIG. 3*a* shows a longitudinal cross-sectional view of the document inverter of FIG. 3 in a different mode of operation.
Figure 3:
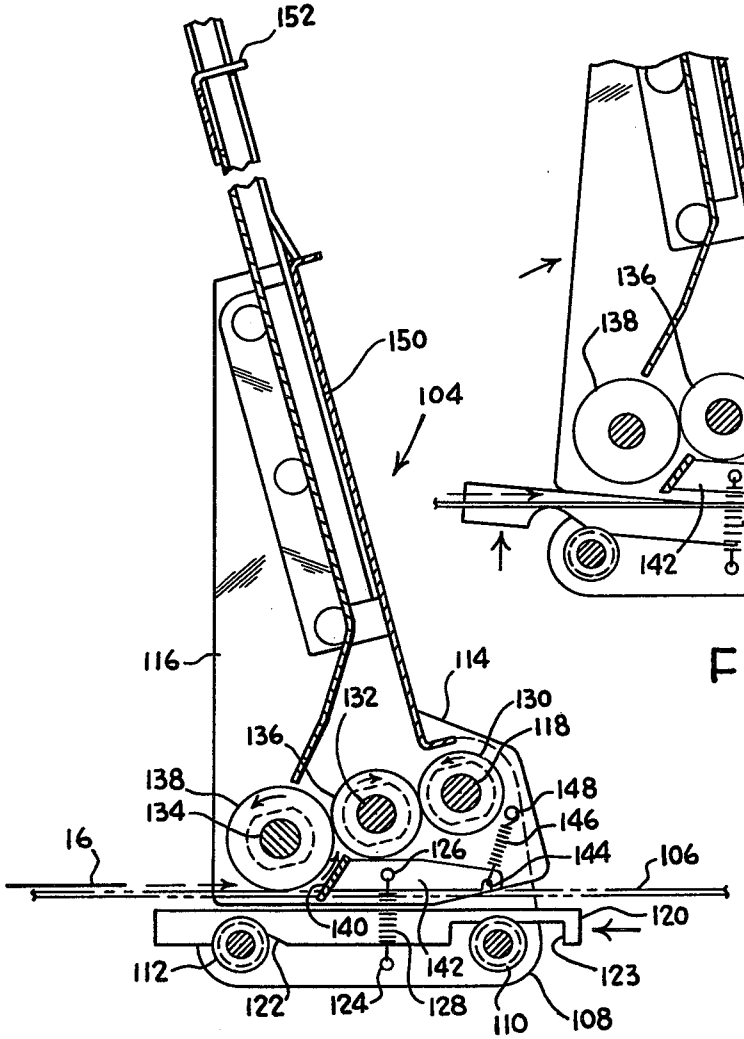
FIG. 3 shows a longitudinal cross-sectional view of a document inverter which incorporates another embodiment of the instant invention.

Another embodiment of the invention is shown in FIG. 3 and 3*a*. A document inverter is generally shown at 104 which may invert a document being conveyed along a single endless conveyor 106. The endless conveyor 106, such as a belt conveyor, may comprise a plurality of belts which are spaced laterally to one another. The inverter 104 has a pair of opposed fixed side frames 108, each of which receives one end of fixed shafts 110 and 112. A housing 114 is disposed between the side frames 108 and the housing 114 has a pair of end walls 116. A pivot shaft 118 is received within the end walls 116 to allow rotation of the housing 114 thereabout. The end walls 116 rest upon a shifting member 120, the shifting member having a cam surface 122 that bears upon one of the fixed shafts 112 and a recess 123 that receives the other fixed shaft 110. In this manner the shifting member 120 may be slid from right to left as shown in FIG. 3*a* thereby allowing the cam surface 122 to ride on the fixed shaft 112 to rotate the housing 114 about the pivot shaft 118. A pin 124 is located in each side frame 108 and a corresponding shaft 126 is received within the end wall 116, each of the corresponding pins 124 and each end of the shaft 126 supporting a compression spring 128. The function of the compression spring 128 is to urge the housing 114 about the pivot shaft 118 in a counter-clockwise rotation as shown in FIG. 3. The shifting member 120, on the other hand, will rotate the housing 114 about the pivot 118 in a counter-clockwise rotation, thereby overcoming the spring 128, when the shifting member 120 is pushed from right to left as shown in FIG. 3*a*.

Received within the housing 114 is a laterally extending idler roller 130 which is mounted for rotation about the stationary shaft 118. Two other shafts 132 and 134 are received within the housing 114, the first shaft 132 being mounted for rotation therein and the second shaft 134 having drive means (not shown). Each of the shafts 132, 134 supports for rotation therewith a roller 136, 138, respectively. Located below the rollers 134, 136 are a plurality of deflectors 140 which are located intermediate the belts 106. The deflectors 140 are supported by a linkage member 142 that is rotatably supported by the shaft 126 and each has a recess 144 therein. The recess 144 receives a spring 146 and supports the same in conjunction with a shaft 148 supported by the housing 114. Disposed above the rollers 130, 136, 138 is a generally vertically extending chute 150 which has an adjustable member 152 therein.

In operation, documents 16 will be conveyed by the belts 106 from left to right as shown in FIGS. 3 and 3*a*. When it is desired that the documents 16 will simply be conveyed without interruption, the shifting member 120 will be pushed all the way to the left thereby raising the housing 114 so that the deflector 140 is located above the belts 106 a sufficient distance as to not to interfer with the transport of the documents 16, as seen in FIG. 3*a*. When it is decided to invert the documents 16, the shifting member 120 will be pushed all the way to the right whereby the fixed shaft 112 will be seated within the cam surface 122 and the deflectors 140 received within the belts 106, as seen in FIG. 3. The documents 16 will thereby be deflected by the deflector 140 between the drive roller 138 and idler roller 136 to be conveyed into the chute 150. The adjusting member 152 may be positioned in order to accomodate documents 16 of various sizes. Once each document 16 is received within the chute 150, that portion which had been the trailing edge will become the leading edge and will be pushed from intermediate the rollers 130, 136 and by the natural action of the rotation of roller 136 intermediate the two rollers 136 and 130 to be driven therebetween back onto the belts 106. In this fashion, the document 16 has been inverted but still travels the same path as all of those documents that had not been inverted.

Figure 4:
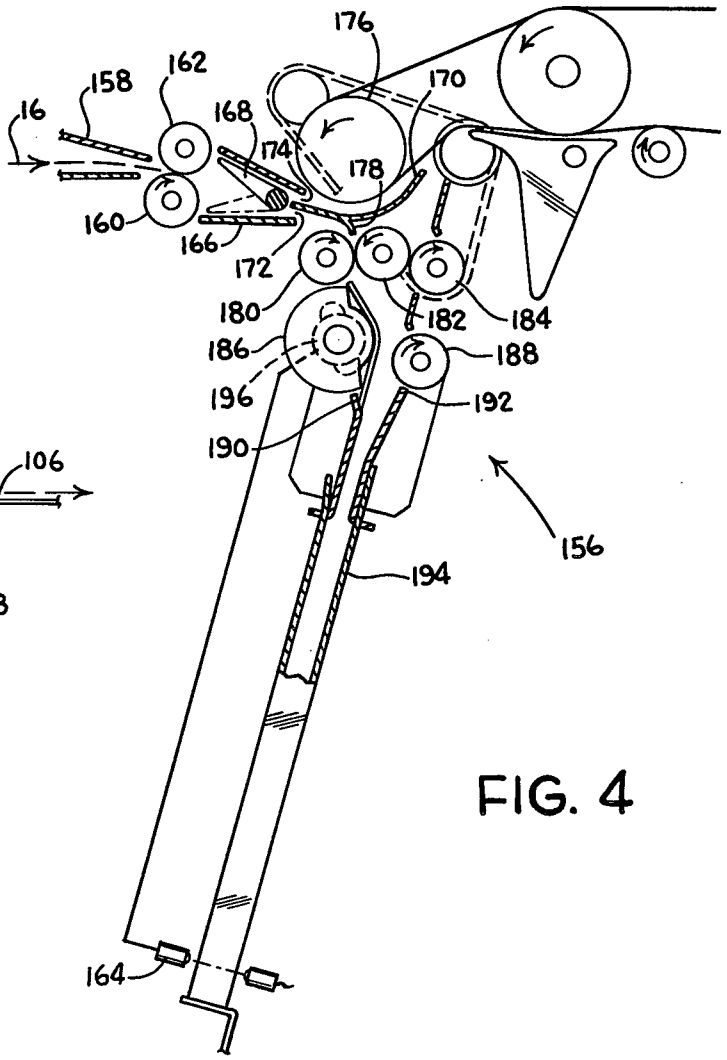
FIG. 4 shows a longitudinal cross-sectional view of a document inverter which incorporates still another embodiment of the invention.

Still another embodiment of the invention is shown in FIG. 4. Here the inverter 156 has a guide member 158 which receives documents 16 therein and guides the same between a pair of rollers 160, 162, one of which is a drive roller. The document 16 exits from these rollers 160, 162 into another guide member 166 which receives therein a pivotable deflector member 168. Received within the downstream portion of the guide 166 is a divider 170 which divides the guide 166 into a pair of openings 172, 174. Immediately above the divider 170 is a drive roller 176 which drives the document 16 into an adjoining apparatus such as a collator stack or sorter. In order to do this, the deflecting member 168 would be its lower most position as shown in FIG. 4.

Suspended from the divider 170 is a finger 178 which is located between a pair of rollers 180, 182, one of rollers 182 being a drive roller. An idler roller 184 is located adjacent the drive roller 182. A flatted drive roll 186 is located between the rollers 180, 182 and spaced relative to a pressure roller 188. The flatted drive roll 186 and pressure rollers 188 are received within openings 190, 192, respectively, of a chute 194. As the deflector member 168 is placed in its upper most position within the guide 166, a document 16 will be diverted from its path to the nip of the rollers 180, 182 and into the chute 194. The flatted drive roll 186 allows the document 16 to freely enter the chute 194, the document being sensed by a sensor 164 so that in proper timed relationship, the flatted drive roll 186 is rotated by a one revolution clutch 196 thereby driving the document 16 in conjunction with the pressure roller 188 between the nip of the rollers 182, 184 where it is directed below the divider 170 and into the same path as those documents which had not been inverted.

What is claimed is:

1. A document inverting comprising:

a. conveyor means for conveying a document along a substantially linear path;

b. a housing located above said path and having
   1. a first pair of spaced, upstream and downstream rollers placed adjacent said path,
   2. a third roller located intermediate and adjacent said pair of rollers, and in driving engagement therewith
   3. means for driving one of said rollers, and
   4. a diverting member located intermediate said third roller and said upstream roller.

c. a shiftable member located adjacent said path opposite said rollers, said shiftable member being operative to place said housing in one of two positions, said diverting member being located in said path when said housing member is in one of said positions and removed from said path when said housing is in its second position, and d. a generally vertically extending chute located above said liner path adjacent said rollers whereby a document is directed into said chute when said diverting member is located in said path.

2. A document inverter comprising:

a. first and second conveyor means spaced relative to one another for conveying a document along a substantially linear path;

b. a first pair of spaced, upstream and downstream drive rollers placed below and adjacent to said path and intermediate said conveyors, said path being adjacent to the perimeters of said drive rollers;

c. a first idler roller located adjacent said path above said downstream drive roller;

d. a shiftable member located above said path and having an idler roller upstream from said first idler roller and having a guide member, said shiftable member having two selectable positions,
   1. said guide member being spaced above said upstream drive roller and said upstream idler roller being placed intermediate said drive rollers and within said path when said shiftable member is in a first position and
   2. said guide member being removed from said path and said upstream idler being located adjacent said path above said upstream drive roller when said shiftable member is in said second position; and e. a generally vertically extending chute located below said path and having an opening positioned intermediate said drive rollers.

3. The document inverter of claim 2 including means for directing the upper end of a document located in said chute from a location between said upstream drive roller and said upstream idler roller to a position between said upstream idler roller and said downstream drive roller.

4. The document inverter of claim 3 including means for sensing the presence of a document in said chute and enabling said directing means.

5. The document inverter of claim 4 wherein the center line of said chute is directed between said upstream idler roller and said downstream drive roller.

6. A document inverter comprising:

a. a conveyor means for conveying a document along a path;

b. a chute located below said path;

c. diverting means located within said path for selectively diverting a document from said path to said chute;

d. means for extracting a document from said chute and directing the document back to said path;

e. said extracting and directing means including a pressure roller located at the upper portion of said chute; and f. a rotatable cam having a one revolution clutch located within said chute spaced relative to said pressure roller, a portion of said cam being engageable with said pressure roller during revolution of said cam.

7. The document of claim 6 including means for sensing the presence of a document in said chute and for enabling said clutch.

* * * * *

UNITED STATES PATENT AND TRADEMARK OFFICE

CERTIFICATE OF CORRECTION

PATENT NO. : 4,078,789

DATED : March 14, 1978

INVENTOR(S) : Lloyd G. Kittredge - Andrew W. Rastorguyeff

It is certified that error appears in the above-identified patent and that said Letters Patent are hereby corrected as shown below:

Title page, column 1, "[73] Assignee:" was left blank, should be -- Pitney-Bowes, Inc., Stamford, Conn. --.

Title page, column 2, "Attorney, Agent, or Firm" left blank, should be -- Peter Vrahotes; William D. Soltow, Jr.; Albert W. Scribner --.

Column 1, line 24, change "or" to -- to --.

Column 2, line 48, insert before "member" -- shift --.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*